US009816779B2

(12) United States Patent
Moon

(10) Patent No.: US 9,816,779 B2
(45) Date of Patent: Nov. 14, 2017

(54) SMART HOLSTER SYSTEM

(71) Applicant: Saeilo Enterprises, Inc., Pomona, NY (US)

(72) Inventor: Kook Jin Moon, Matamoras, PA (US)

(73) Assignee: Saeilo Enterprises, Inc., Pomona, NY (US)

( * ) Notice: Subject to any disclaimer, the term of this patent is extended or adjusted under 35 U.S.C. 154(b) by 150 days.

(21) Appl. No.: 14/521,974

(22) Filed: Oct. 23, 2014

(65) Prior Publication Data

US 2016/0116253 A1 Apr. 28, 2016

Related U.S. Application Data

(60) Provisional application No. 61/894,493, filed on Oct. 23, 2013.

(51) Int. Cl.
*F41C 33/02* (2006.01)
*F41A 17/06* (2006.01)

(52) U.S. Cl.
CPC ..... *F41C 33/029* (2013.01); *F41A 17/06* (2013.01); *F41C 33/0263* (2013.01)

(58) Field of Classification Search
CPC ..... A45F 2200/0591; Y10S 224/911–224/913; F41C 33/02–33/029
USPC ..... 224/192–193, 198, 238, 243–244, 224/911–912
See application file for complete search history.

(56) References Cited

U.S. PATENT DOCUMENTS 5,394,717 A 3/1995 Yu
5,449,103 A * 9/1995 Tilley ..... F41A 17/063 224/244
5,758,524 A 6/1998 Yu
5,918,784 A 7/1999 Serpa
2001/0019071 A1* 9/2001 Vor Keller ..... F41A 17/066 224/244
2001/0033228 A1* 10/2001 Kisreman ..... F41C 33/0263 340/568.1

(Continued)

OTHER PUBLICATIONS

Article Re: "Personalized gun" (Redirected from Smart gun), pp. 1-6, http://en.wikipedia.org/wiki/Smart_gun, dated Sep. 30, 2013.

(Continued)

*Primary Examiner* — Nathan J Newhouse
*Assistant Examiner* — Phillip Schmidt
(74) *Attorney, Agent, or Firm* — Alix, Yale & Ristas, LLP

(57) ABSTRACT

A smart holster system includes a holster and an electronic data storage device (EDSD) having authorized user identification information stored therein. The holster includes a holster body, a latch and a control system. The holster body forms a compartment having a latch receptacle, where the trigger area of a handgun stored in the compartment is disposed within the latch receptacle. A first portion of the latch is moveable between extended withdrawn positions with the latch first portion being disposed within the latch receptacle when it is in the extended position. The control system unlocks the holster when a control system EDSD reader detects the authorized user identification information stored in the EDSD, permitting movement of the latch first portion from the extended position to the withdrawn position.

26 Claims, 14 Drawing Sheets

(56) References Cited

U.S. PATENT DOCUMENTS

| | | | | |
|---|---|---|---|---|
| 2002/0105303 | A1* | 8/2002 | Kishi | H02J 7/0047 320/134 |
| 2002/0153396 | A1* | 10/2002 | French | F41C 33/0209 224/244 |
| 2009/0237203 | A1 | 9/2009 | Determan et al. | |
| 2012/0223110 | A1* | 9/2012 | Gregory | F41C 33/0263 224/193 |
| 2014/0067617 | A1* | 3/2014 | Heine | G06Q 10/0875 705/26.81 |
| 2014/0223195 | A1* | 8/2014 | Wei | H04L 9/0897 713/190 |

OTHER PUBLICATIONS

Article Re: "Could smart gun technology make us safer?", by Lucas Mearian, dated Dec. 20, 2012, pp. 1-6, Computerworld, http://www.computerworld.com/s/article/print/9234905/Could_smart_gun_technology_ma . . . , Sep. 30, 2013.

Article Re: "Can 'Smart Gun' Technology Help Prevent Violence?" by Dan Bobkoff, dated Mar. 18, 2013, pp. 1-4, http://www.npr.org/blogs/alltechconsidered/2013/03/18/174629446/can-smart-gun-technol . . . , Sep. 30, 2013.

Article Re: "Spotlight: Smart Gun Technology Works" NJIT, New Jersey Institute of Technology, The Edge in Knowledge, news publication dated Jan. 2005, pp. 1-2, http://www.njit.edu/news/spotlight/2005/jan/index.php Sep. 30, 2013.

Article Re: "New Smart Gun Technology Allows Owners to Control the Trigger Safety with an App", by Joanna Stern, dated May 28, 2013, pp. 1-2, ABC News, http://abcnews.go.com/Technology/yardarms-smart-gun-technology-owners-control-trigge . . . Sep. 30, 2013.

* cited by examiner

SMART HOLSTER SYSTEM

CROSS-REFERENCE TO RELATED APPLICATIONS

This application claims the benefit under 35 U.S.C. §119 (e) of U.S. Provisional Patent Application Ser. No. 61/894,493 filed Oct. 23, 2013.

BACKGROUND

This disclosure relates generally to handguns. More particularly, the present disclosure relates to holsters used to hold a handgun on the body of a user.

A large amount of research has been expended to develop a personalized gun or smart gun, with the goal of preventing the unauthorized use of guns. Such research has included the use of RFID chips, biometrics, and magnetic rings. Only the magnetic ring concept has been reduced to a commercial product due to problems 1) reducing the electronics employed by the other concepts to a size that is compatible with handguns and 2) hardening the electronics employed by the other concepts such that they may reliably survive the shock of firing the handgun.

SUMMARY

There is provided a smart holster system for housing a handgun having a trigger and a trigger area disposed proximate to the trigger. The holster system comprises an EDSD having authorized user identification information stored therein and a holster. The holster includes a holster body, a latch and a control system. The holster body forms a longitudinally extending compartment having a latch receptacle. The holster compartment is adapted to receive the handgun with the handgun trigger area disposed within the latch receptacle. The latch includes a first portion having an extended position and a withdrawn position. The latch first portion is disposed within the latch receptacle when the latch first portion is in the extended position. The control system includes an EDSD reader. The control system unlocks the holster when the EDSD reader detects the EDSD having authorized user identification information stored therein whereby the latch first portion is orthogonally movable from the extended position to the withdrawn position.

The control system may also includes a controller processor and an energy storage device, where the EDSD reader is in communication with the controller processor.

The controller processor may include read/write memory and read only memory. A main control operating system and the authorized user identification information may be stored in the read only memory and an event log may be stored in the controller processor read/write memory.

The controller processor may also include a small peripheral interface bus, an A/D to measure energy storage device voltage and sound emitter.

The holster body may also include an upper wall, a lower wall, a right sidewall, a left sidewall, an outer surface and an inner surface defining the compartment. An opening may extend through one of the sidewalls to the latch receptacle, where the latch first portion is orthogonally movable through the opening into the latch receptacle.

The holster may also include a gun sensor adapted to sense the presence or absence of a handgun, the gun sensor being disposed on a lower wall of the holster body.

The EDSD reader may be an EDSD reader/writer having reader and writer portions, with the writer portion storing the authorized user identification information into the EDSD.

The holster also includes a locking member and a driver connected to the control system to move the locking member between a locked position and an unlocked position. The locking member locks the latch first portion in the extended position when the locking member is in the locked position and the control system actuates the driver to move the locking member to the unlocked position when the EDSD reader detects the EDSD with the authorized user identification information.

The latch may also include a second portion disposed above the first portion and the holster may further include a latch pivot pin disposed intermediate the latch first and second portions pivotally mounting the latch to the holster body and a latch spring biasing the latch first portion to the extended position.

The control system may also include a controller processor, an energy storage device and a wake-up button. The energy storage device is conserved by maintaining the controller processor in a sleep condition, the wake-up button waking the controller processor for operation.

The driver may be a latching solenoid and the locking member may be a latch locking pin.

The driver may be a motor having a motor shaft with the locking member connected to the motor shaft. The motor rotates the locking member 180 degrees to move the locking member between the locked and unlocked positions.

The holster may also include a driver connected to the control system and the latch to move the latch first portion between the extended and withdrawn positions. The control system actuates the driver to move the latch first portion to the withdrawn position when the EDSD reader detects the EDSD with the authorized user identification information.

The control system may also include a controller processor, an energy storage device and a thumb break having a sensor connected to the controller processor, with the sensor transmitting a signal when the thumb break is opened or closed. The energy storage device is conserved by maintaining the controller processor in a sleep condition, the thumb break sensor waking the controller processor for operation.

There is also provided a method of preventing an unauthorized user from removing a handgun having a trigger and a trigger area disposed proximate to the trigger from a holster. The holster includes a holster body forming a longitudinally extending compartment having a latch receptacle. The holster compartment is adapted to receive the handgun with the handgun trigger area disposed within the latch receptacle. The holster also includes a control system and a latch having a first portion with extended and withdrawn positions. The latch first portion is disposed within the latch receptacle when the latch first portion is in the extended position. The control system having authorized user identification information and an EDSD reader. The method comprises bringing an EDSD proximate to the holster, sensing the EDSD with the EDSD reader and unlocking the holster if the EDSD reader detects the authorized user identification information stored in the EDSD.

The holster also includes a wake-up button and the control system also has a controller processor having the authorized user identification information stored therein. The method also comprises putting the controller processor to sleep when the control system is not operating and waking the controller processor to operate the control system by pressing the wake-up button.

The method further includes starting an EDSD timer after the controller processor has awoken, counting a first predetermined period of time with the EDSD timer, querying the EDSD reader to determine whether the EDSD having the authorized user identification information has been sensed and putting the controller processor to sleep if the authorized user identification information is not sensed within the first predetermined period of time.

The method further includes actuating a driver connected to the control system to move a locking member from a locked position to an unlocked position if the authorized user identification information is sensed within the first predetermined time limit, starting an unlock timer after the holster has been unlocked and counting a second predetermined period of time with the unlock timer.

The method may further include moving the latch first portion from the extended position to the withdrawn position if the second predetermined period of time has not passed, removing the handgun from the holster compartment, moving the latch first portion from the withdrawn position to the extended position, and actuating the driver to move the locking member from the unlocked position to the locked position. If the handgun is not removed from the holster before the second predetermined period of time has passed, the driver is actuated to move the locking member from the unlocked position to the locked position.

The method further includes putting the controller processor to sleep after the holster is locked.

The method may further include moving the latch first portion from the extended position to the withdrawn position if the second predetermined period of time has not passed, selectively removing the handgun from the holster compartment, querying a gun sensor to determine whether the handgun has been removed from the holster and putting the controller processor to sleep if the handgun has been removed from the holster. If the handgun has not been removed from the holster, the latch first portion is moved from the withdrawn position to the extended position, the driver is actuated to move the locking member from the unlocked position to the locked position and the controller processor is put to sleep.

The control system may include an energy storage device and an energy storage device voltage measuring device providing a sensed voltage to the control system. The method would then include an energy storage device logic subroutine comprising querying the energy storage device voltage measuring device for the sensed voltage and starting an alert timer subroutine if the sensed voltage drops below a predetermined alert threshold. The alert timer subroutine initiates an alert timer that counts a predetermined period of time, an audio alert is initiated when the predetermined period of time has passed, and the alert timer is restarted. The holster is unlocked if the sensed voltage drops below a predetermined shutdown threshold.

Starting the EDSD timer initiates an EDSD timer subroutine comprising querying the EDSD timer to determine whether the first predetermined period of time has passed and stopping the EDSD timer if the first predetermined period of time has passed. If the first predetermined period of time has not passed, the controller processor queries whether the wake-up button has been pressed and restarts the EDSD timer if the wake-up button has been pressed.

Starting the unlock timer initiates an unlock timer subroutine comprising querying the unlock timer to determine whether the second predetermined period of time has passed and stopping the unlock timer if the second predetermined period of time has passed. If the second predetermined period of time has not passed, the controller processor queries whether the wake-up button has been pressed and restarts the unlock timer if the wake-up button has been pressed.

The unlock timer subroutine also includes restarting the unlock timer if the EDSD having the authorized user identification information is sensed.

DETAILED DESCRIPTION

Figure 1:
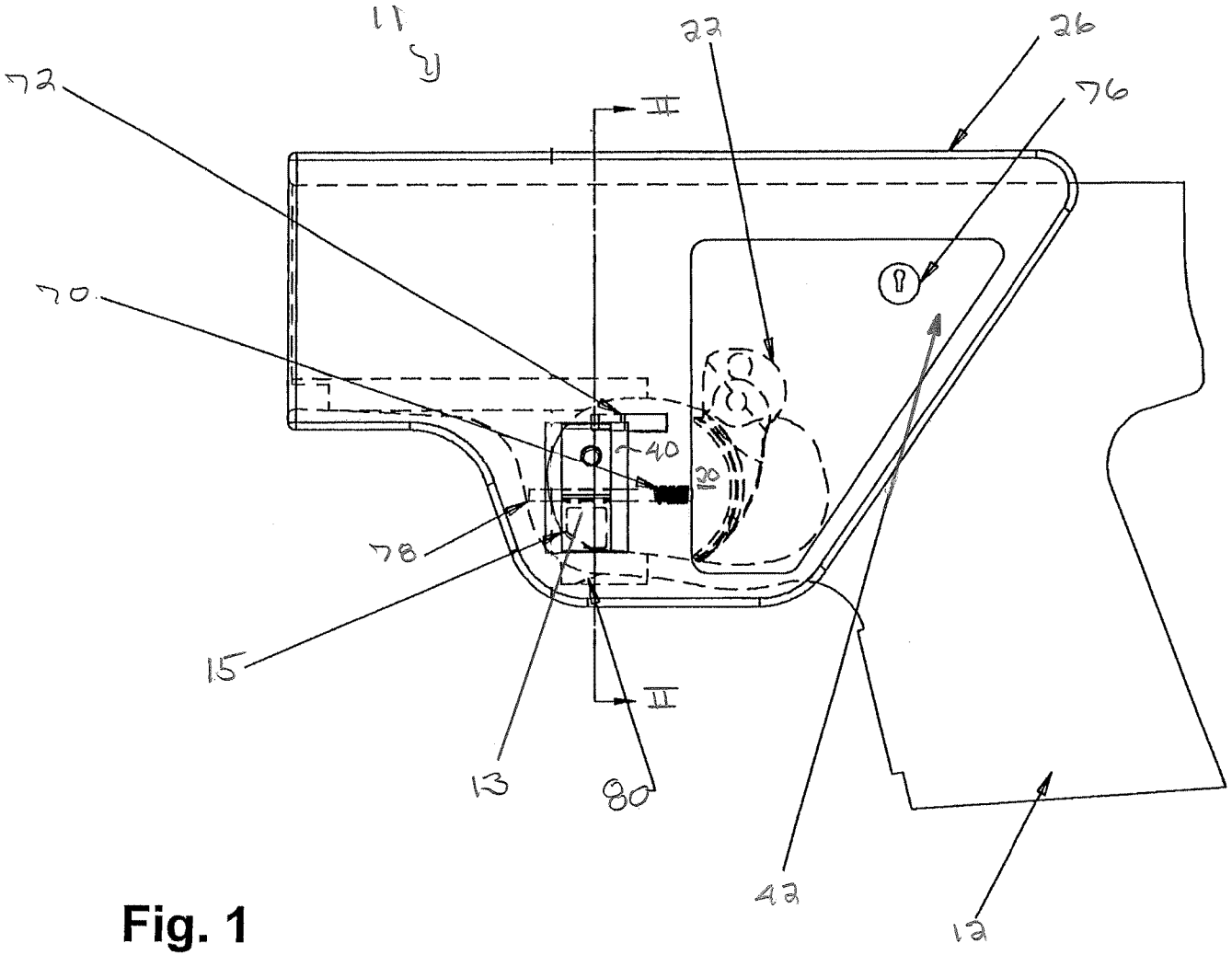
FIG. 1 is a schematic side view, partly in phantom, of a first embodiment of a smart holster in accordance with the disclosure.

A smart holster system 10, 10' in accordance with the subject description prevents the unauthorized use of a handgun 12 that is stored within the compartment 14 of the holster 11, 11'. It should be appreciated that when a handgun 12 is stored, or holstered, within the holster compartment 14, the trigger area 20 of the holstered gun is positioned within a latch receptacle 13 of the holster compartment 14.

Figure 5:
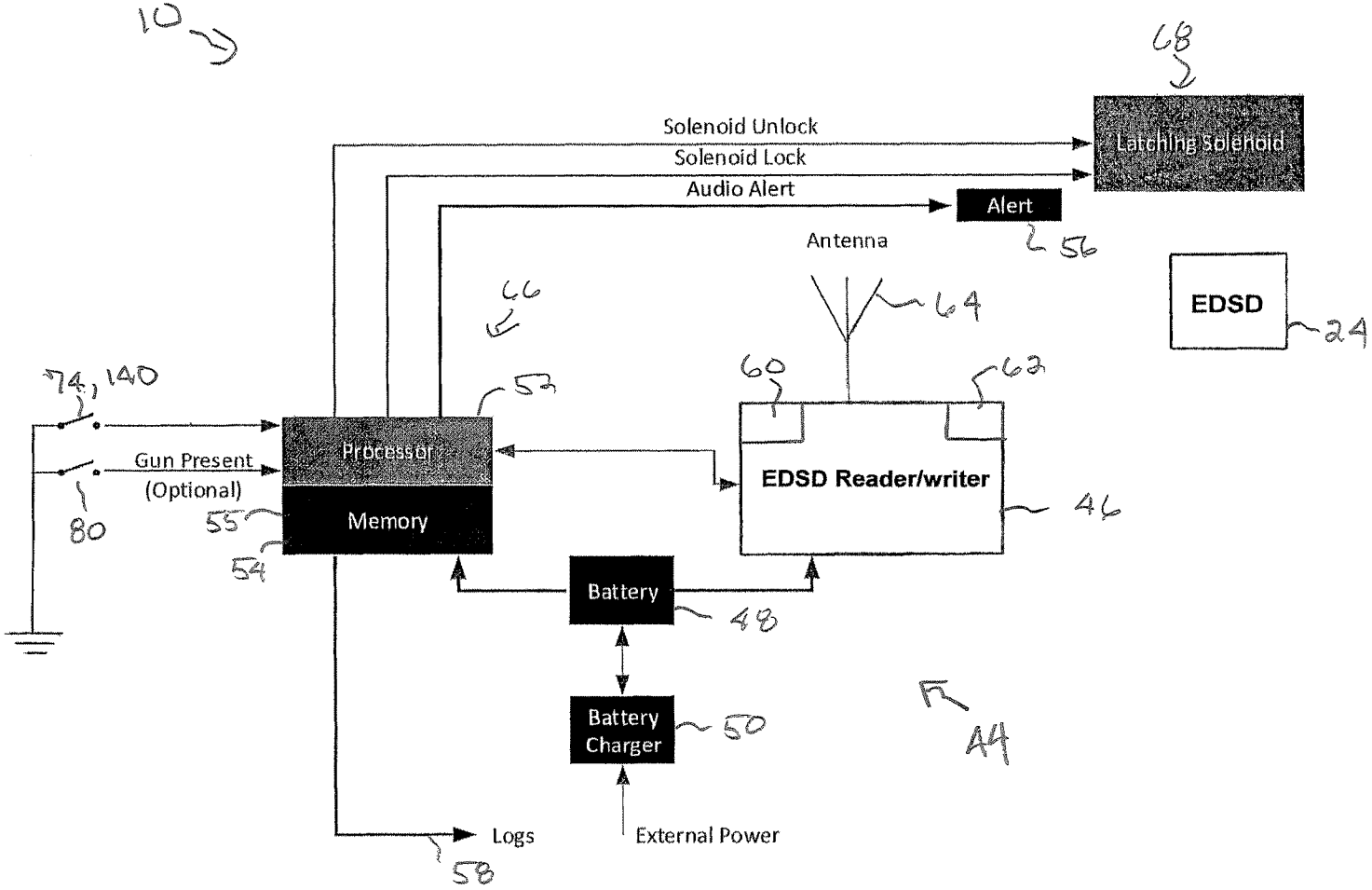
FIG. 5 is a schematic diagram of the smart holster system in accordance with the disclosure.

FIGS. 1-4 are schematic views of a first embodiment of a holster 11 in accordance with the disclosure and FIG. 5 is a schematic diagram of the smart holster system 10. The holster 11 includes a latch 15 including upper and lower portions 16, 18, the lower portion 18 having extended and withdrawn positions. When the latch lower portion 18 is in the extended position, it extends orthogonally into the latch receptacle 13 whereby the latch lower portion 18 is positioned within the trigger area 20 of a holstered handgun 12, preventing unauthorized removal of the handgun 12 from the holster 11 and operation of the trigger 22 until the latch lower portion 18 is moved to the withdrawn position. The authorized handgun user possesses an electronic data storage device (EDSD) 24 that authorizes removal of the handgun 12 from the holster 11.

An "electronic data storage device" 24 is a machine-writeable and machine-readable device capable of storing electronic data. Electronic data storage device 24 refers to a single electronic data storage device as well as a collection of two or more electronic data storage devices connected, for example, in series, in parallel, or nested one within another. Examples of electronic data storage devices 24 include, but are not limited to, radio frequency identification tags (RFID tags), proximity (Prox) tags, iButtons, smartcards, and similar devices. In one embodiment the EDSD is "wearable", having the form of but not limited to a bracelet, ring, etc.

With reference to FIGS. 1-5, the holster 11 includes a holster body 26 having an upper wall 28, a lower wall 30, right and left sidewalls 32, 34, an outer surface 36 and an inner surface 38 forming the compartment 14. An opening 40 extends through the lower portion of one of the sidewalls 32, 34 to the latch receptacle 13. An electronics compartment 42 is mounted to the outer surface 36 of one of the sidewalls 32, 34, preferably the sidewall having the opening 40. Elements of the control system 44, including a controller processor 52, an EDSD reader or EDSD reader/writer 46 connected to the controller processor 52, an energy storage device such as a rechargeable battery 48 and a battery charging circuit 50 are disposed within the electronics compartment 42.

The controller processor 52 includes read/write memory 54 and read only memory 55, similar to the Texas Instrument MSP430. The processor 52 also includes a Small Peripheral Interface (SPI) bus onboard as well as an analog-to-digital converter (A/D) for measuring the battery voltage. A fixed volume, single frequency sound emitter 56 is connected to the controller processor 52 to provide an audio alert when the sensed battery voltage drops below a predetermined value. The read/write memory 54 provides the capability of logging at least 100 events. Each event may be logged with a day, hour, minute and second once the power is first applied to the controller. Logs may be removed only at the factory using a special connector 58.

The reader portion 60 of the EDSD reader/writer 46 is used to read the EDSD 24. The writer portion 62 may be used for pairing an EDSD 24 to the device during manufacturing or for in the field by writing identification information from the read only memory 55. An example of the EDSD reader/writer 46 is the Texas Instrument TRF7960A module. Alternatively, an EDSD reader may be used, with the EDSDs 24 being paired to the device during manufacturing. An antenna 64 connected to the EDSD reader/EDSD reader/writer 46 may be built into the controller printed circuit board (PCB) 66 or built into the holster 11 and thus external to the PCB 66.

The holster 11 also includes a driver, a latch spring 70, a locking member such as a latch locking pin 72, a wake-up button 74 and a key operated override 76 to manually unlock the holster 11. The driver unlocks the holster 11, 11'. In the example of the holster 11 shown in FIGS. 1-4 and 6, the driver is a latching solenoid 68 that imparts motion to the latch locking pin 72. In the example of the variation shown in FIGS. 14-17, the driver is a motor 146 that imparts motion to a locking member 148. The latch locking pin 72 and the locking member 148 are moved from a locked position to an unlocked position, unlocking the holster and allowing the user to operate the latch 15, 15'. In the example of the holster 11' shown in FIGS. 12 and 13, the driver may be a latching solenoid 68' or a motor 142 that moves the latch 144, unlocking the holster. It should be appreciated that other drivers for imparting motion to the latch locking pin 72, such as a motor (as shown in FIGS. 12-17), electromagnets, etc., may be used in place of the latching solenoid 68.

The latch lower portion 18 is biased in the extended position by the latch spring 70. The latching solenoid 68 holds the locking pin 72 both in and out without power on it. The controller processor 52 activates the latching solenoid 68 with a discrete output to extend the locking pin 72 (and stay extended) and a separate discrete output to withdraw the locking pin 72 (and stay withdrawn). When the locking pin 72 is extended it locks the latch lower portion 18 in the extended position, preventing removal of the holstered gun 12. When the locking pin 72 is withdrawn the user may operate the latch 15 by pushing the latch upper portion 16 towards the holster body sidewall 32, 34 against the force of the latch spring 70, pivoting the latch 15 around the latch pivot pin 78, whereby the latch lower portion 18 is moved to the withdrawn position.

To conserve the power of the battery 48 and increase the time between replacement or recharging, the controller processor 52 is normally in a sleep/dormant condition. A key operated override 76 is provided to manually unlock the holster 11 in the event that the battery charge is too low to power the controller processor 52. The wake-up button 74 provides a discrete input to the controller processor 52 to wake the controller processor 52. A variation of the holster 11 also includes a gun sensor 80 located in lower wall 30 that will sense the presence or absence of a gun 12 in the holster 11.

Figure 6:
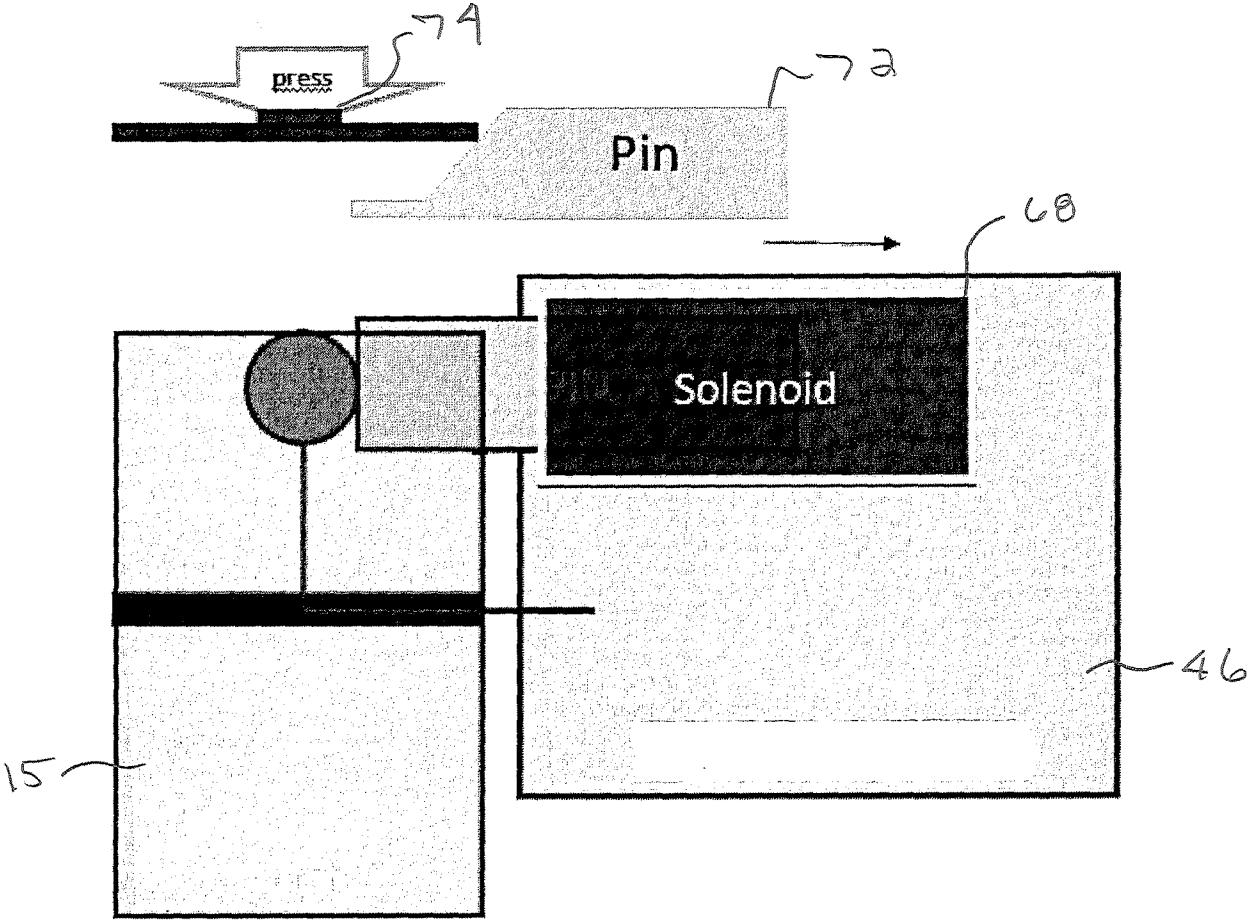
FIG. 6 is a schematic view of the wake-up button, latch locking pin, solenoid, RFID module and latch of the smart holster of FIG. 1.
Figure 7:
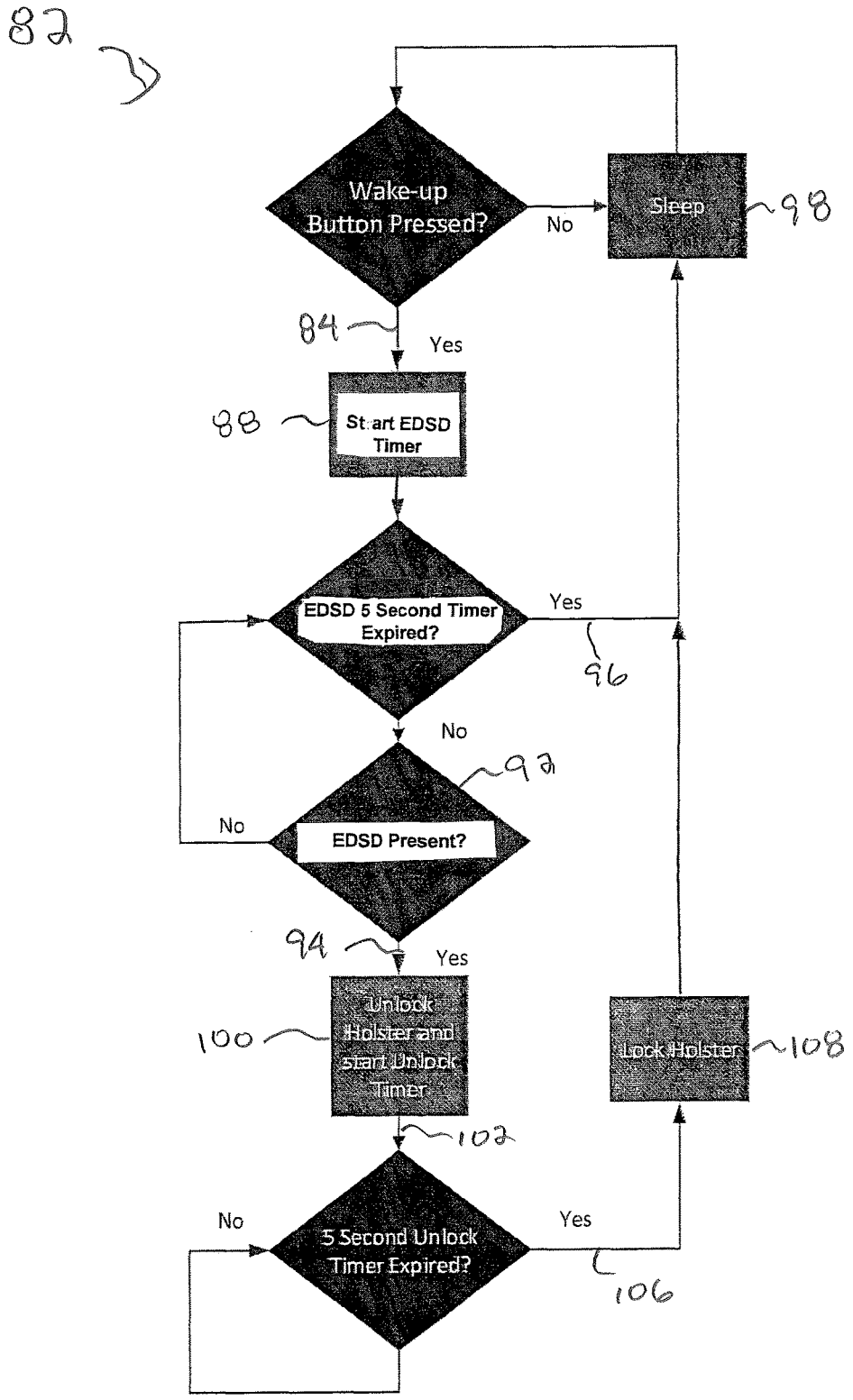
FIG. 7 is a flow diagram of the method of operation of a first variation of the smart holster system.
Figure 10:
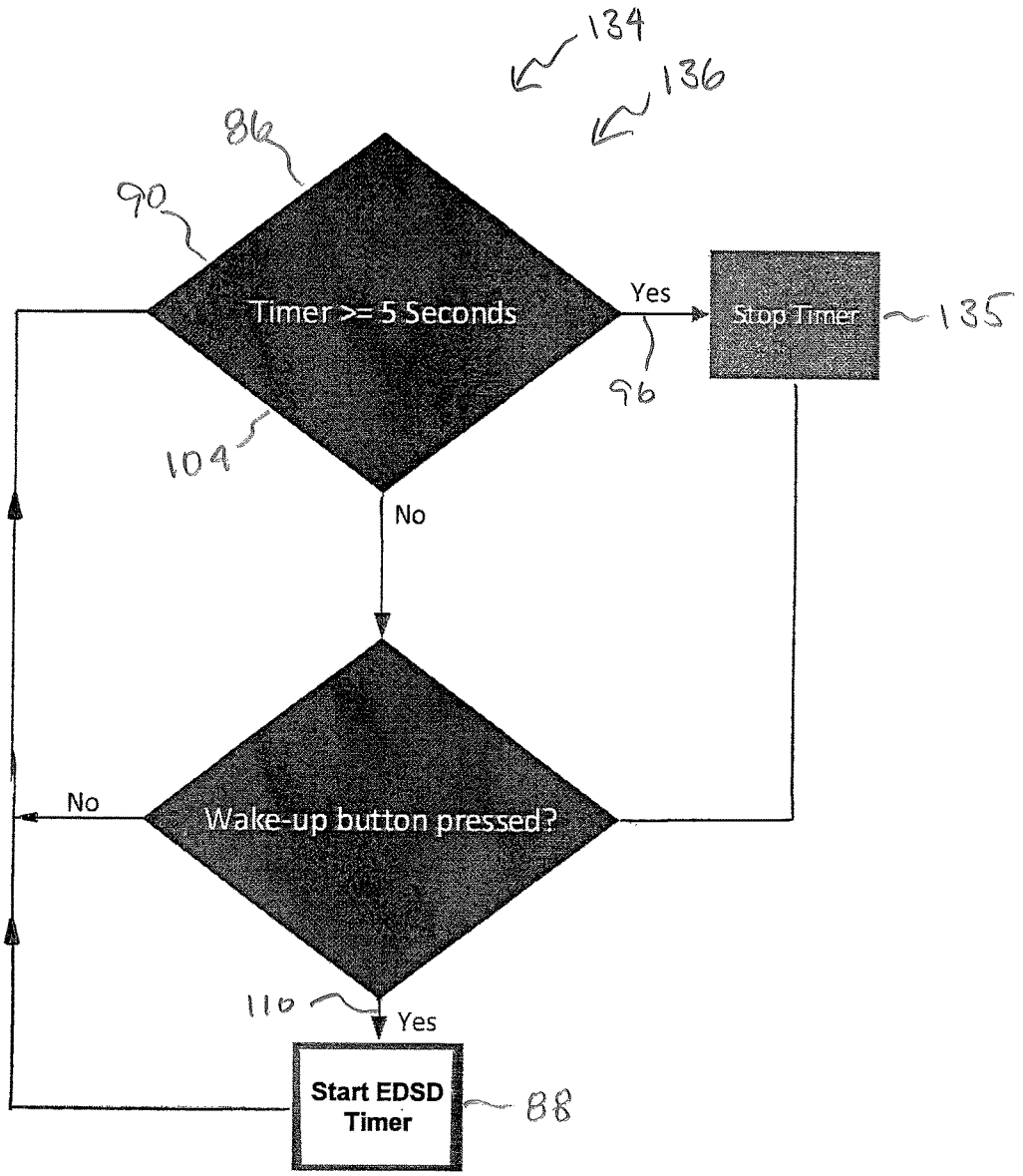
FIG. 10 is a flow diagram of the EDSD timer/unlock timer subroutines.

With reference to FIGS. 6, 7 and 10, the processor main control operating system 82 wakes up when the wake-up button 74 is pressed 84. Once the input is debounced, an EDSD Timer 86 (5 seconds) is initiated 88. As the EDSD timer 86 counts down 90, the processor 52 queries 92 the EDSD reader/writer 46 to determine whether the EDSD 24 having the proper identification information has been sensed 94. If the EDSD timer 86 expires 96 before the EDSD reader/EDSD reader/writer 46 signals that the EDSD 24 has been sensed, the processor 52 goes back to sleep 98. If the EDSD reader/EDSD reader/writer 46 senses 94 the presence of an authorized user's EDSD 24, the processor 52 actuates 100 the latching solenoid 68 to withdraw the latch locking pin 72, unlocking the holster 11 and starting 102 the unlock timer 104 (5 seconds). The user then has 5 seconds to operate the latch 15 and remove the gun 12 from the holster 11. When the unlock timer 104 expires 106, the processor 52 actuates the latching solenoid 68 to extend the locking pin 72, locking the holster 11 and the processor 52 goes back to sleep. Pressing the wake-up button 74 re-starts any timer that is running.

Figure 8:
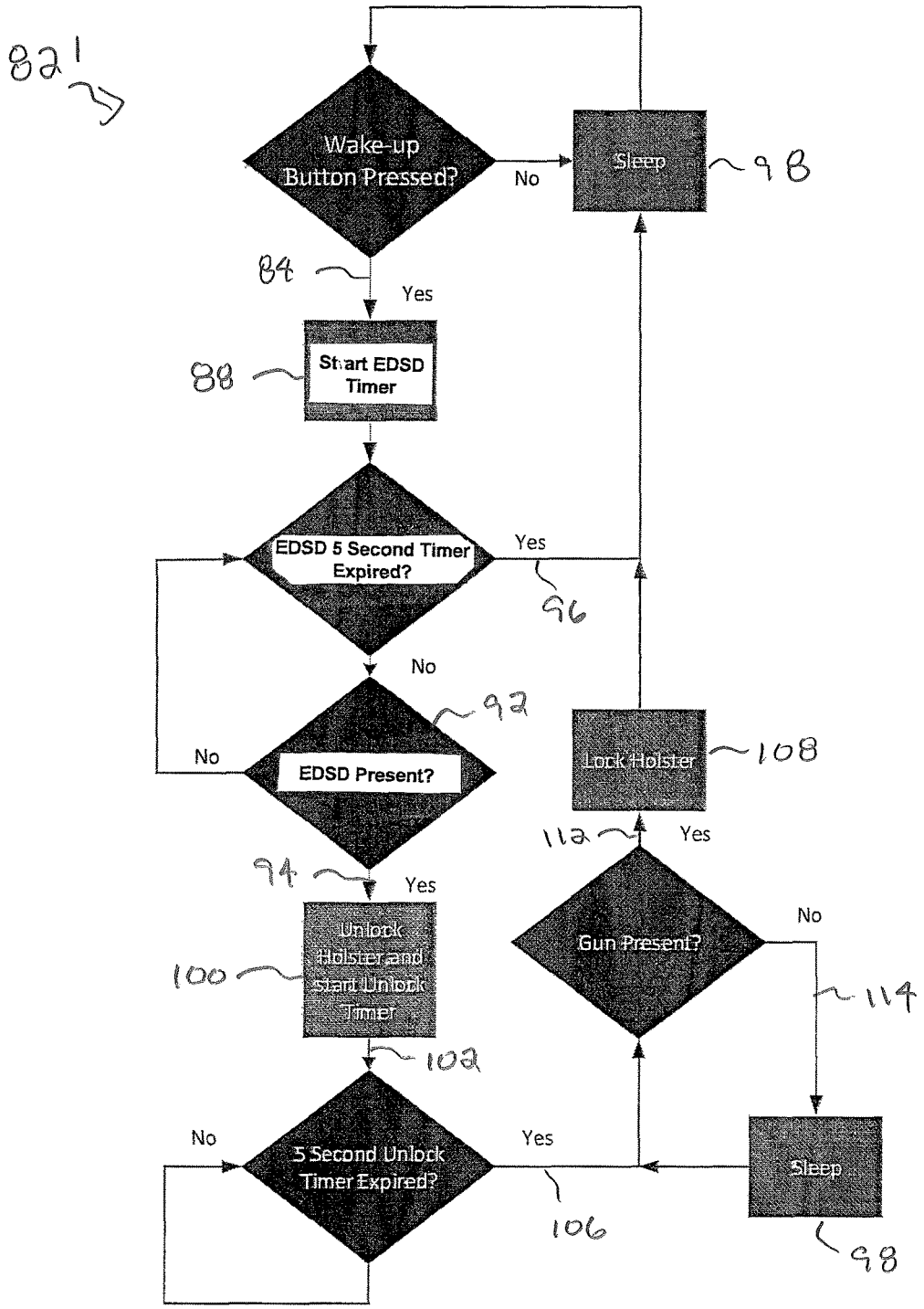
FIG. 8 is a flow diagram of the method of operation of a second variation of the smart holster system.

With reference to FIG. 8, in the variation having the gun sensor 80, the processor main control operating system 82' wakes up when the wake-up button 74 is pressed 84. Once the input is debounced, the EDSD Timer 86 (5 seconds) is initiated 88. As the EDSD timer 86 counts down 90, the processor 52 queries the EDSD reader/writer 46 to determine whether the EDSD 24 has been sensed 94. If the EDSD timer 86 expires 96 before the EDSD reader/EDSD reader/writer 46 signals that the EDSD 24 has been sensed, the processor 52 goes back to sleep 98. If the EDSD reader/EDSD reader/writer 46 senses 94 the presence of an authorized user's EDSD 24, the processor 52 actuates 100 the latching solenoid 68 to withdraw the latch locking pin 72, unlocking the holster 11 and starting the unlock timer 104 (5 seconds). The user then has 5 seconds to operate the latch 15 and remove the gun 12 from the holster 11. When the unlock timer 104 expires 106, if the gun sensor 80 determines that the gun 12 is holstered 112, the processor 52 actuates the latching solenoid 68 to extend the locking pin 72, locking the holster 11 and the processor 52 goes to sleep. If the gun sensor 80 determines that the gun is not holstered 114, the processor 52 will go to sleep 98 until the gun sensor 80 determines that the gun is holstered 112. Once the gun 12 is holstered 112, the processor 52 actuates the latching solenoid 68 to extend the locking pin 72, locking the holster 11 and the processor 52 goes back to sleep 98. Pressing the wake-up button 74 re-starts any timer that is running.

Figure 9:
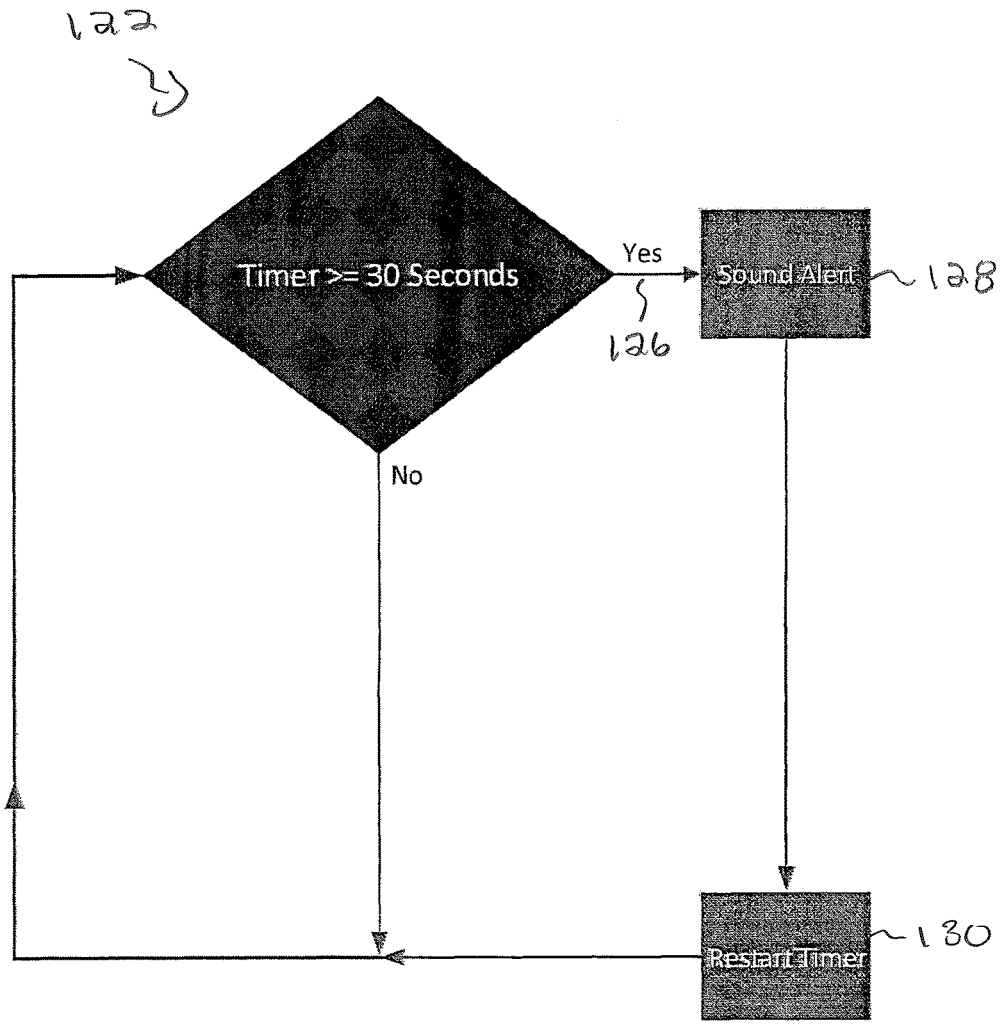
FIG. 9 is a flow diagram of the alert timer subroutine.
Figure 11:
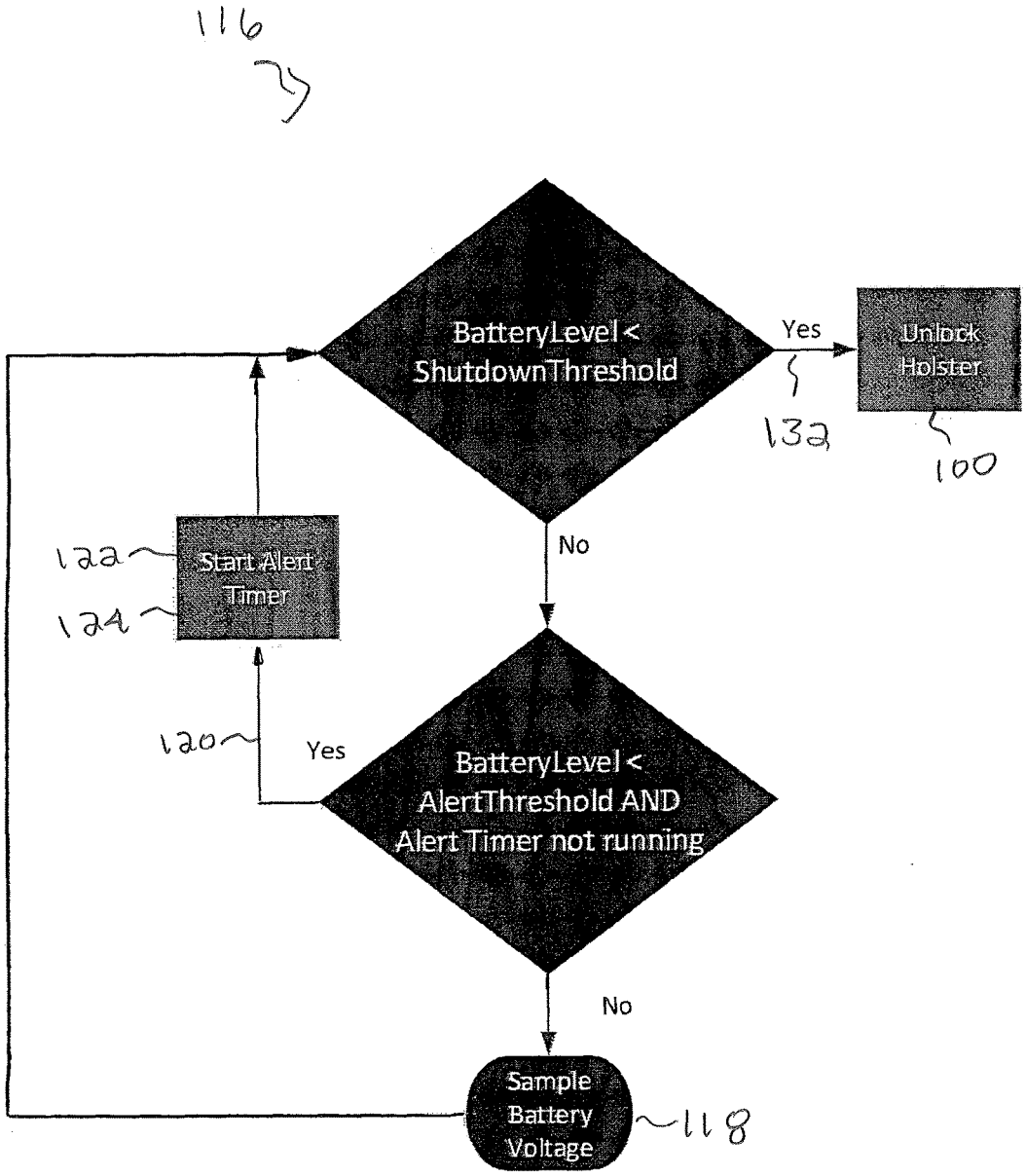
FIG. 11 is a flow diagram of the battery logic subroutine.

With reference to FIGS. 9 and 11, a battery logic subroutine 116 continuously monitors 118 the battery voltage. If the sensed battery voltage drops below a predetermined alert threshold 120, the processor 52 starts an alert timer subroutine 122 that starts an alert timer 124 (30 seconds). When the alert timer expires 126, the processor 52 initiates a short audio alert 128 and restarts the alert timer 130 such that the alert sounds every thirty seconds. If the sensed battery voltage continues to drop such that it drops below a predetermined shutdown threshold 132, the processor 52 actuates the latching solenoid 68 to withdraw the latch locking pin 72, unlocking 100 the holster 11. The holster 11 remains unlocked until the power is cycled (battery removed or replaced).

With reference to FIG. 10, the processor 52 initiates (or reinitiates) an EDSD timer subroutine 134 every time the wake-up button 74 is pressed independent of when it is pressed during the main control operating system 82, 82'. When the EDSD 86 timer expires 96, the EDSD timer subroutine 134 is turned off 135. Preferably, the EDSD timer 86 has a resolution of no less than 1 second. The unlock timer subroutine 136 is identical to the EDSD timer subroutine 134 with the exception that the unlock timer subroutine 136 is also initiated when an EDSD 24 is detected.

Figure 12:
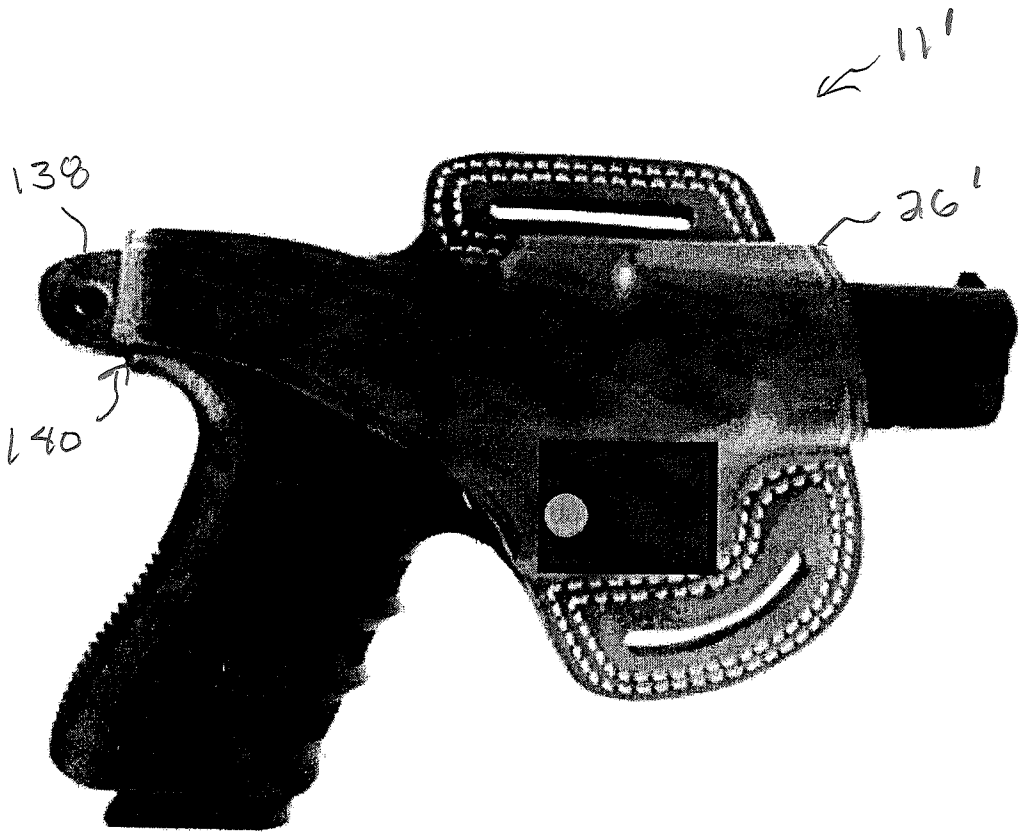
FIG. 12 is a side view of a second embodiment of a smart holster in accordance with the disclosure.
Figure 13:
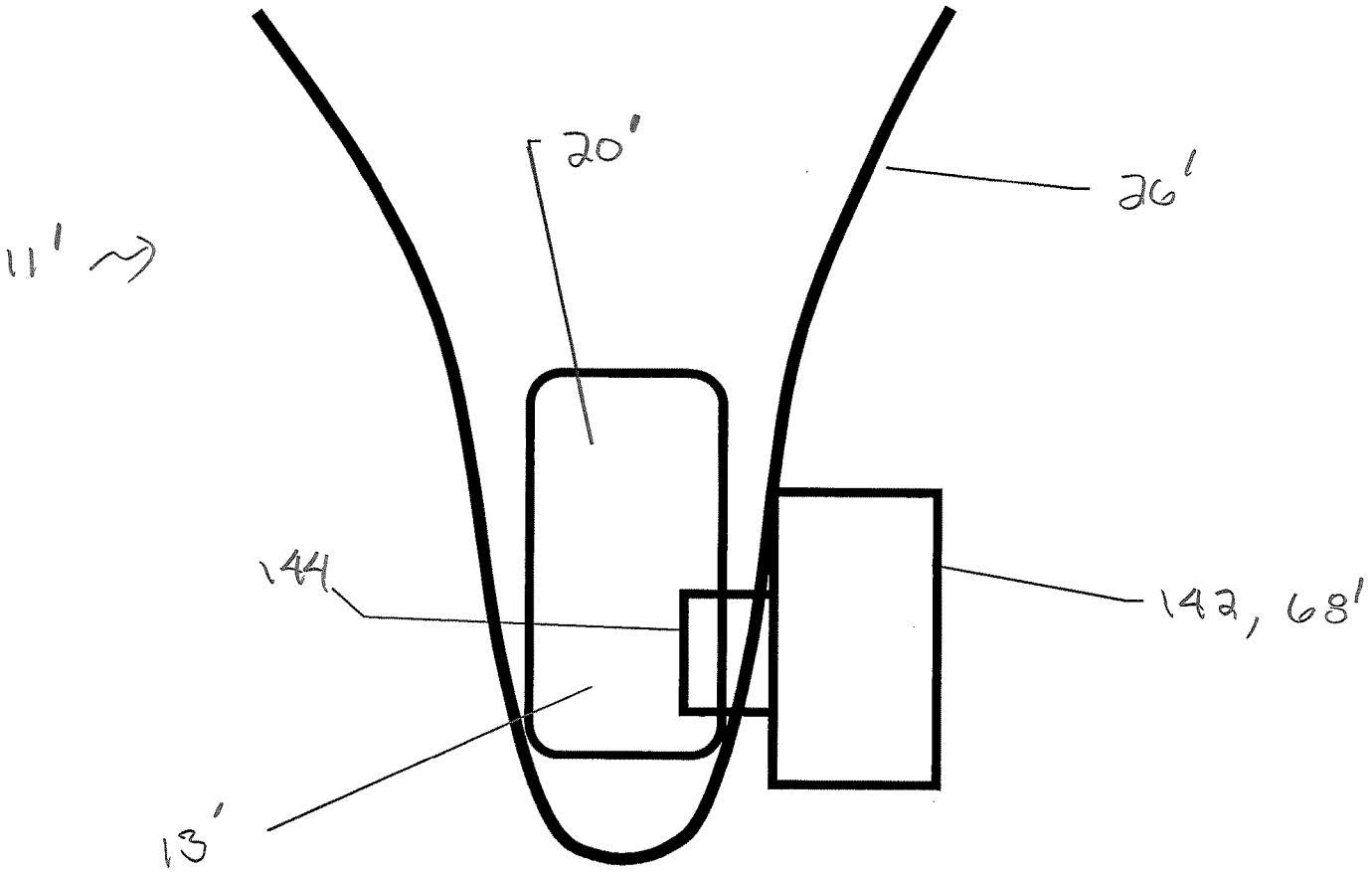
FIG. 13 is a schematic diagram of the smart holster of FIG. 12.

With reference to FIGS. 12 and 13, in a second embodiment of a smart holster 11' in accordance with the disclosure the wake-up button 74 is replaced by a thumb break 138 having a sensor 140 that sends a signal when the thumb break 138 is opened or closed. The thumb break signal replaces the signal from the wake-up button 74 in FIG. 5, whereby the processor main control operating system 82, 82' wakes up when the thumb break 138 is opened. In this embodiment the driver may be a motor 142 or a solenoid 68' whereby the latch 144 is moved orthogonally into and out of the latch receptacle 13' and the trigger area 20' of a holstered gun 12, whereby the holster 11' is locked and unlocked.

Figure 2:
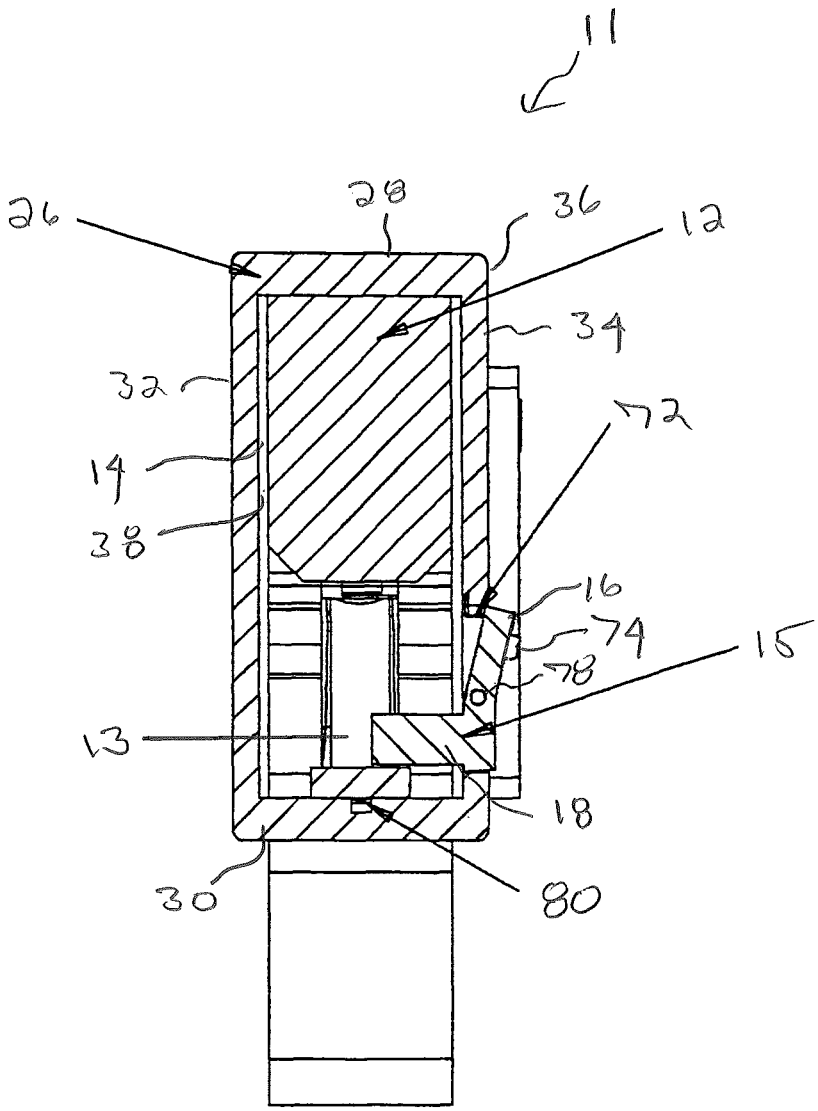
FIG. 2 is a cross-section view, taken along line II-II of FIG. 1.
Figure 3:
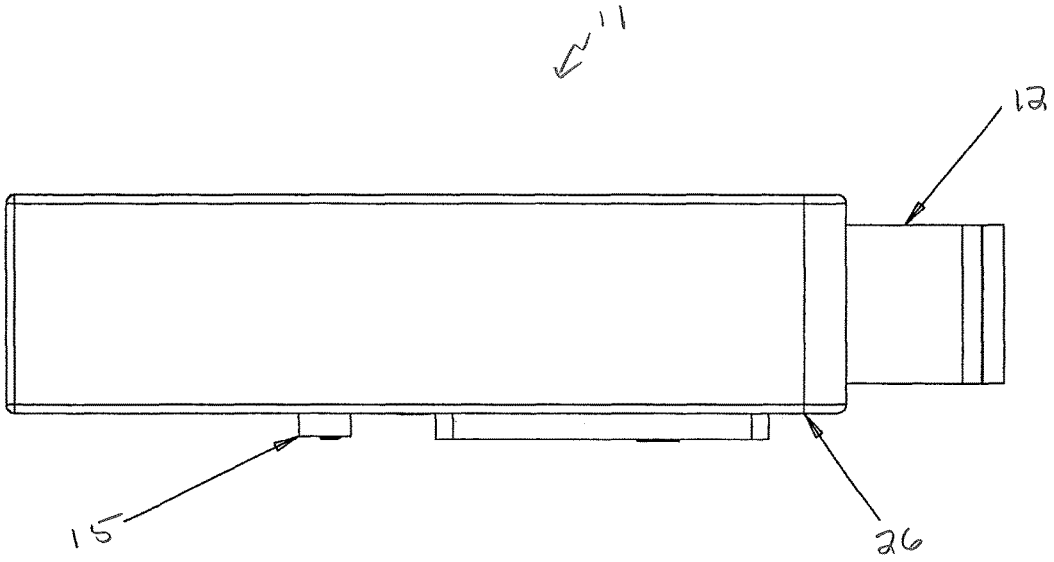
FIG. 3 is a top view of the smart holster of FIG. 1.
Figure 4:
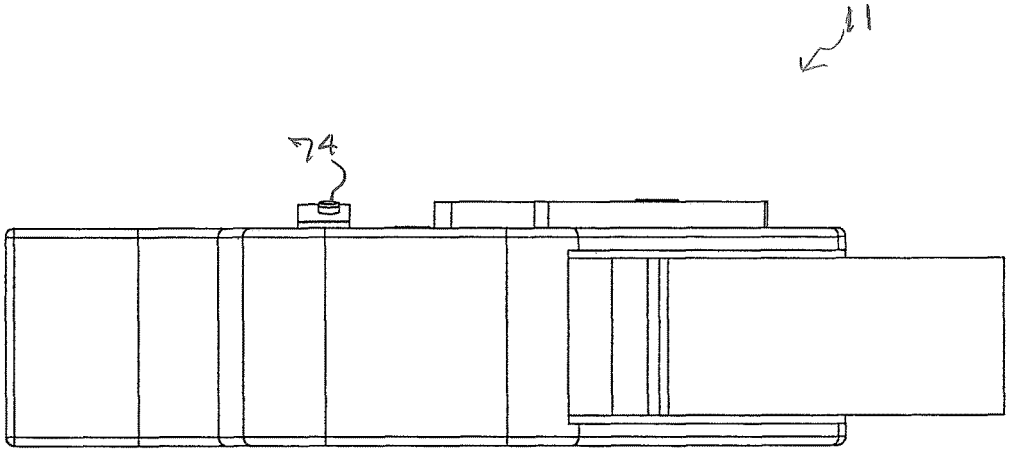
FIG. 4 is a bottom view of the smart holster of FIG. 1.

With reference to FIGS. 14-17, in a variation of the latch and drive shown in FIGS. 1, 2 and 5, the driver is motor 146 and a T-shaped locking member 148 is mounted on the distal end portion 150 of the motor shaft 152. The latch 15' includes upper and lower portions 16', 18' that are pivotally moveable around the latch pivot pin 78'. When the latch lower portion 18' is in the extended position 154, it extends orthogonally into the latch receptacle 13" preventing removal of a holstered handgun 12. When the latch lower portion 18' is in the withdrawn position 156 a holstered handgun 12 may be removed from the holster.

Figure 14:
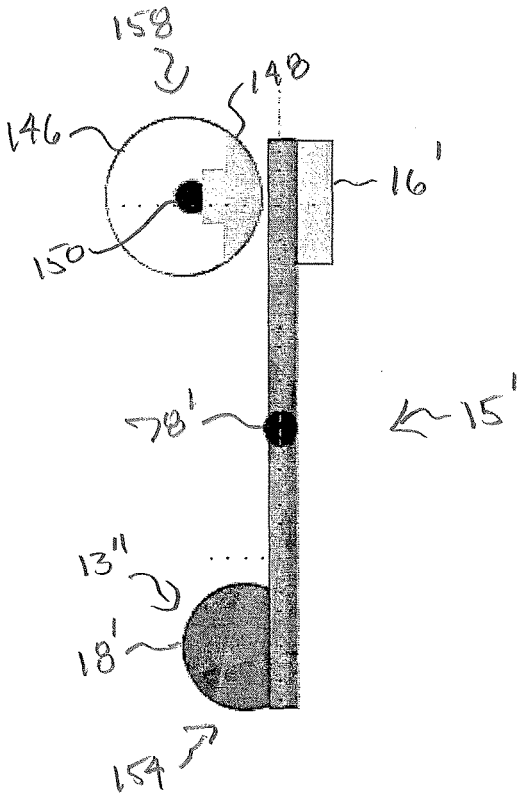
FIG. 14 is a schematic side view of a variation the latch and driver of FIG. 1, showing the holster in a locked condition.
Figure 15:
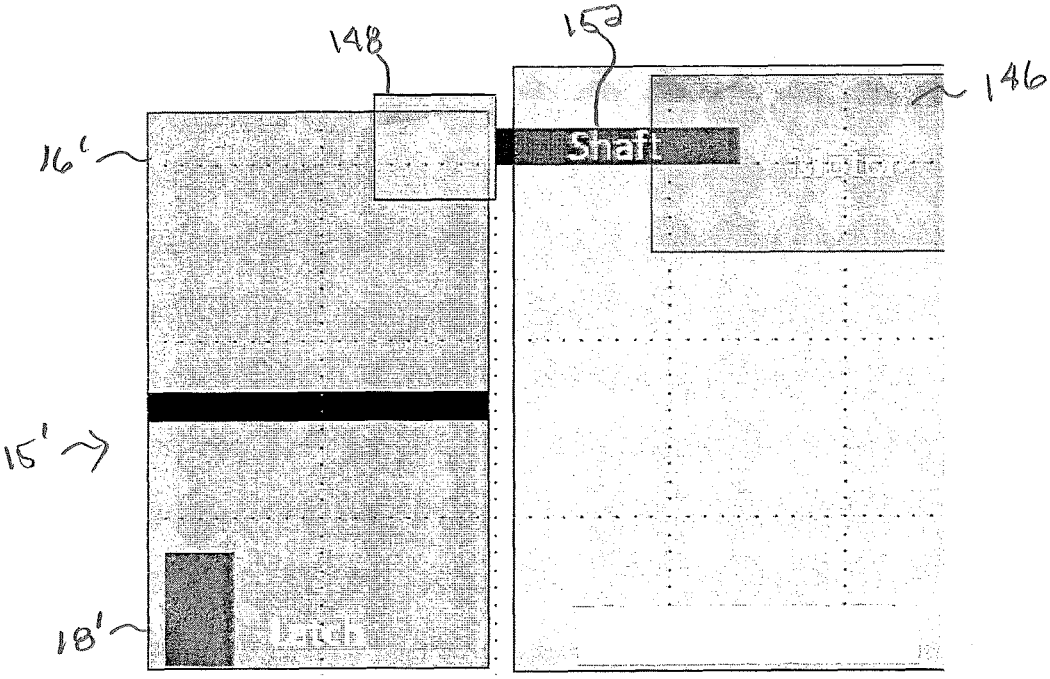
FIG. 15 is a schematic front view of the latch and driver of FIG. 14.
Figure 16:
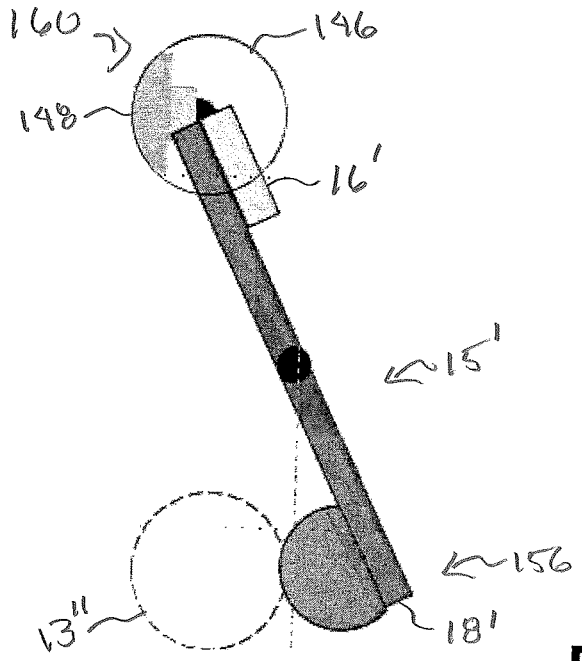
FIG. 16 is a schematic side view of the latch and driver of FIG. 14, showing the holster in an unlocked condition.
Figure 17:
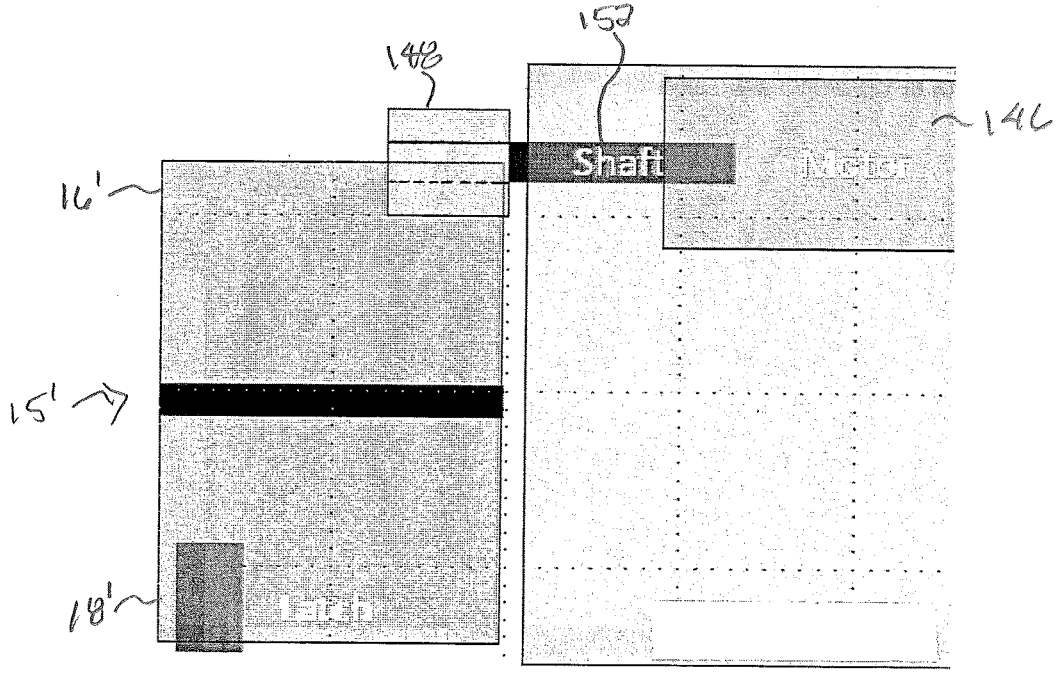
FIG. 17 is a schematic front view of the latch and driver of FIG. 16.

The locking member 148 is shown in a locked position 158 in FIGS. 14 and 15, preventing movement of the latch upper portion 16' toward the holster body sidewall 32, 34. The holster is unlocked by rotating the locking member 148 one hundred and eighty (180) degrees to the unlocked position 160 with the motor shaft 152 (FIGS. 16 and 17), allowing the user to push the latch upper portion 16' toward the holster body sidewall 32, 34, pivoting the latch 15' around the latch pivot pin 78', whereby the latch lower portion 18' is moved to the withdrawn position 156. The holster is locked by rotating the locking member 148 one hundred and eighty (180) degrees to the locked position 158 with the motor shaft 152 (FIGS. 14 and 15) locking the latch lower portion 18' in the extended position 154.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A smart holster system for housing a handgun having a trigger and a trigger area disposed proximate to the trigger, the holster system comprising:

an EDSD having authorized user identification information stored therein; and a holster including:

a holster body defining a longitudinally extending compartment having a latch receptacle, the holster compartment being adapted to receive the handgun with the handgun trigger area disposed within the latch receptacle, a latch including a first portion having an extended position and a withdrawn position, the latch first portion being disposed within the latch receptacle when the latch first portion is in the extended position, and a control system including an EDSD reader;

a locking member movable between a locked position and an unlocked position via a driver connected to the control system;

wherein the control system unlocks the holster when the EDSD reader detects the EDSD having authorized user identification information stored therein whereby the latch first portion is orthogonally movable from the extended position to the withdrawn position, and wherein the locking member is rotated 180 degrees between the locked position and the unlocked position.

2. A smart holster system for housing a handgun having a trigger and a trigger area disposed proximate to the trigger, the holster system comprising:

an EDSD having authorized user identification information stored therein; and a holster including:

a holster body defining a longitudinally extending compartment having a latch receptacle, the holster compartment being adapted to receive the handgun with the handgun trigger area disposed within the latch receptacle, a latch including a first portion having an extended position and a withdrawn position, the latch first portion being disposed within the latch receptacle when the latch first portion is in the extended position, and a control system including an EDSD reader;

a locking member movable between a locked position and an unlocked position;

a driver connected to the control system to move the locking member between the locked position and the unlocked position, wherein the driver is a motor having a motor shaft, the locking member is connected to the motor shaft, the latch also includes a second portion disposed above the first portion, and the holster further includes a latch pivot pin pivotally mounting the latch to the holster body, the latch pivot pin being disposed intermediate the latch first and second portions, wherein the latch first portion is movable from the extended position to the withdrawn position when the latch locking pin is in the unlocked position, wherein the control system unlocks the holster when the EDSD reader detects the EDSD having authorized user identification information stored therein whereby the latch first portion is orthogonally movable from the extended position to the withdrawn position, and wherein the motor rotates the locking member 180 degrees to move the locking member between the locked and unlocked positions.

3. The smart holster system of claim 2 wherein the control system also includes:

a controller processor;

an energy storage device; and wherein the EDSD reader is in communication with the controller processor.

4. The smart holster system of claim 3 wherein the controller processor includes:

read/write memory; and read only memory, a main control operating system and the authorized user identification information being stored therein.

5. The smart holster system of claim 4 wherein the control system also includes an event log stored in the controller processor read/write memory.

6. The smart holster system of claim 4 wherein the controller processor also includes:

a serial peripheral interface bus; and an analog-to-digital converter (A/D) to measure energy storage device voltage.

7. The smart holster system of claim 3 wherein the control system also includes a sound emitter connected to the controller processor.

8. The smart holster system of claim 2 wherein the holster body includes:

an upper wall;

a lower wall;

a right sidewall;

a left sidewall;

an outer surface;

an inner surface defining the compartment; and an opening extending through one of the sidewalls to the latch receptacle;

wherein the latch first portion is orthogonally movable through the opening into the latch receptacle.

9. The smart holster system of claim 2 wherein the holster also includes a gun sensor adapted to sense the presence or absence of a handgun.

10. The smart holster system of claim 8 wherein the holster body includes a lower wall, the gun sensor being disposed on the lower wall.

11. The smart holster system of claim 4 wherein the EDSD reader is an EDSD reader/writer having reader and writer portions, the writer portion storing the authorized user identification information into the EDSD.

12. The smart holster system of claim 11 wherein the controller processor provides the authorized user identification to the EDSD reader/writer from the controller processor read only memory.

13. The smart holster system of claim 2 wherein the locking member locks the latch first portion in the extended position when the locking member is in the locked position and the control system actuates the driver to move the locking member to the unlocked position when the EDSD reader detects the EDSD having authorized user identification information stored therein.

14. The smart holster system of claim 13 wherein the latch also includes a second portion disposed above the first portion, the holster further including:

a latch pivot pin pivotally mounting the latch to the holster body, the latch pivot pin being disposed intermediate the latch first and second portions; and a latch spring biasing the latch first portion to the extended position;

wherein the latch first portion is movable from the extended position to the withdrawn position when the locking member is in the unlocked position.

15. The smart holster system of claim 14 wherein the holster body includes a sidewall having an outer surface, the latch second portion extending outwardly from the sidewall outer surface when the latch first portion is in the extended position.

16. The smart holster system of claim 13 wherein the control system also includes:

a controller processor;

an energy storage device; and a wake-up button;

wherein the energy storage device is conserved by maintaining the controller processor in a sleep condition, the wake-up button waking the controller processor for operation.

17. The smart holster system of claim 13 wherein the driver is a latching solenoid and the locking member is a latch locking pin.

18. The smart holster system of claim 2 wherein the holster body includes a sidewall having an outer surface, the latch second portion extending outwardly from the sidewall outer surface when the latch first portion is in the extended position.

19. The smart holster system of claim 2 wherein the driver is connected to the control system and the latch to move the latch first portion between the extended and withdrawn positions; wherein the control system actuates the driver to move the latch first portion to the withdrawn position when the EDSD reader detects the EDSD having authorized user identification information stored therein.

20. The smart holster system of claim 19 wherein the control system also includes:

a controller processor;

an energy storage device; and a thumb break having a sensor connected to the controller processor, the sensor transmitting a signal when the thumb break is opened or closed;

wherein the energy storage device is conserved by maintaining the controller processor in a sleep condition, the thumb break sensor waking the controller processor for operation.

21. A smart holster system for housing a handgun having a trigger and a trigger area disposed proximate to the trigger, the holster system comprising:

an EDSD having authorized user identification information stored therein; and a holster including:

a holster body including an upper wall, a lower wall, a right sidewall, a left sidewall, an outer surface, an inner surface defining a longitudinally extending compartment having a latch receptacle, the holster compartment being adapted to receive the handgun with the handgun trigger area disposed within the latch receptacle, and an opening extending through one of the sidewalls to the latch receptacle, a latch including a first portion, the latch first portion being orthogonally movable between an extended position and a withdrawn position, the latch first portion extending through the holster body opening into the latch receptacle when the latch first portion is in the extended position, and a second portion disposed above the first portion, the latch second portion extending outwardly from the outer surface of the one latch body sidewall when the latch first portion is in the extended position, a latch pivot pin pivotally mounting the latch to the holster body, the latch pivot pin being disposed intermediate the latch first and second portions, a latch spring biasing the latch first portion to the extended position, a control system including a controller processor having read/write memory, and read only memory, a main control operating system and the authorized user identification information being stored therein, an energy storage device, and an EDSD reader in communication with the controller processor, a locking member, the locking member being movable between a locked position and an unlocked position, and a driver connected to the controller processor to move the locking member between the locked and unlocked positions;

wherein the locking member locks the latch first portion in the extended position when the locking member is in the locked position and the controller processor actuates the driver to move the locking member to the unlocked position when the EDSD reader detects the EDSD having authorized user identification information stored therein, whereby the latch first portion is movable from the extended position to the withdrawn position, and wherein the driver is a motor having a motor shaft and the locking member is connected to the motor shaft, the motor rotating the locking member 180 degrees to move the locking member between the locked and unlocked positions.

22. The smart holster system of claim 21 wherein the controller processor also includes:

a serial peripheral interface bus; and an analog-to-digital converter (A/D) to measure energy storage device voltage.

23. The smart holster system of claim 22 wherein the control system also includes a sound emitter connected to the controller processor.

24. The smart holster system of claim 21 wherein the holster also includes a gun sensor adapted to sense the presence or absence of a handgun, the gun sensor being disposed on the holster body lower wall.

25. The smart holster system of claim 21 wherein the driver is a latching solenoid and the locking member is a latch locking pin.

26. The smart holster system of claim 21 wherein the control system also includes a wake-up button, wherein the energy storage device is conserved by maintaining the controller processor in a sleep condition, the wake-up button waking the controller processor for operation.

* * * * *